US007947885B2

(12) United States Patent
Klanner

(10) Patent No.: US 7,947,885 B2
(45) Date of Patent: May 24, 2011

(54) MUSIC STRING

(75) Inventor: Franz Klanner, Vienna (AT)

(73) Assignee: Thomastik-Infeld Gesellschaft m.b.H., Vienna (AT)

( * ) Notice: Subject to any disclaimer, the term of this patent is extended or adjusted under 35 U.S.C. 154(b) by 0 days.

(21) Appl. No.: 12/203,959

(22) Filed: Sep. 4, 2008

(65) Prior Publication Data

US 2009/0064840 A1 Mar. 12, 2009

Related U.S. Application Data

(60) Provisional application No. 60/970,098, filed on Sep. 5, 2007.

(30) Foreign Application Priority Data

Sep. 5, 2007 (AT) ..... 1381/2007

(51) Int. Cl.
*G10D 3/00* (2006.01)

(52) U.S. Cl. ..... 84/297 S

(58) Field of Classification Search ..... 84/309, 84/297 R, 297 S

See application file for complete search history.

(56) References Cited

U.S. PATENT DOCUMENTS

| | | | | |
|---|---|---|---|---|
| 3,605,544 | A | 9/1971 | Kondo | |
| 3,610,084 | A * | 10/1971 | Behringer | 84/397 |
| 4,170,161 | A * | 10/1979 | Kaftan | 84/312 R |
| 5,817,960 | A | 10/1998 | Sanderson | |
| 6,107,556 | A * | 8/2000 | Gilliam | 84/454 |
| 6,348,646 | B1 * | 2/2002 | Parker et al. | 84/297 R |
| 7,408,101 | B2 * | 8/2008 | Shelton | 84/297 S |

FOREIGN PATENT DOCUMENTS

| | | | |
|---|---|---|---|
| JP | 53-95614 | A | 8/1978 |
| JP | 53095616 | A * | 8/1978 |

* cited by examiner

*Primary Examiner* — Kimberly R Lockett
(74) *Attorney, Agent, or Firm* — Henry M. Feiereisen; Ursula B. Day

(57) ABSTRACT

A music string (1), in particular for bowing and/or plucking instruments, having at least a first play area (2), wherein the first play area is provided for the musician to induce tone-generating vibrations. To provide a sound character that is particularly balanced and open over the entire frequency range that can be used for playing and to provide particularly balanced handling characteristics, it is proposed that the first play area (2) has, under identical test conditions that can be predefined, at least a first area (3) having a first vibration behavior and a second area (4) having a second vibration behavior, and that the first vibration behavior is different from the second vibration area.

15 Claims, 1 Drawing Sheet

MUSIC STRING

BACKGROUND OF THE INVENTION

The invention relates to a music string in accordance with the preamble of patent claim 1.

Known music strings have substantially homogeneous mechanical characteristics across their length in the play sections of the music strings. The music strings are clamped on musical instruments, such as violins or guitars, and generate sounds from these musical instruments, whereby a musician engages the music string by, e.g., bowing or plucking. To generate vibrations of different frequencies, and, thus, to generate different notes and tone colors, the string is clamped off at a shortened length by either the fingers of the musician or a mechanical clamp. This results in a shortened string having a higher vibration frequency since each vibrating string has an eigenfrequency that merely depends on its mechanical characteristics. The plucking and bowing merely supplies energy. It has proven to be disadvantageous that the sound of a string that is clamped off at shortened string lengths is significantly different from the sound of the same string at a longer vibrating string length. The more the vibrating and/or clamped off string length decreases, the more the strings typically assume a sound character that is increasingly perceived as closed and/or narrow. Therefore, music instruments have different sound characters in different frequency ranges or, to use music jargon, in different harmonies and different handling characteristics and/or a different play experience for the musician. Since string instruments often allow for inducing one and the same tone on different strings having different lengths, respectively, the musical instrument exhibits a different sound character in one and the same frequency range, depending on which string and in which harmony (position of the hand on the fingerboard) the tone was generated, as a result of which the sound character of the respective musical instrument as well as the interpretation and/or the performance of the composition can suffer.

SUMMARY OF THE INVENTION

It is therefore an object of the invention to provide a music string of the above-mentioned kind that avoids the mentioned disadvantages and that has a particularly balanced and open sound character over the entire frequency range usable for playing and that has particularly balanced handling characteristics.

In accordance with the invention, this is achieved by 1 a music string, in particular for bowing and/or plucking instruments, having at least a first play area, wherein the first play area is provided for the musician to induce tone-generating vibrations, wherein under identical test conditions which can be predefined, the first play area has at least a first area having a first vibration behavior and a second area having a second vibration behavior, and wherein the first vibration behavior is different from the second vibration behavior.

Thereby, music strings are defined that have a particularly balanced and open sound character over the entire frequency range usable for playing and that have particularly balanced handling characteristics. Due to the different vibration characteristics in different playable areas and/or different frequency ranges under identical test conditions, the differences of the various effective string lengths and/or the unique characteristics of musical instruments can be taken into account and compensated for. This leads to further possibilities for individual sound adjustment by the musician because such music strings very strongly respond to the musician's fastening of the music string. Thus, such music strings may change their sound character. Thereby, it is possible for the musician to fine tune the music string, whereby the music string can be matched even better to the instrument and/or the musical composition to be performed.

The invention further relates to a method for stringing a stringed musical instrument, e.g., a violin, including a music string.

Known music strings do not allow for the possibility of influencing their sound character. Thus, it is only possible for the musician to use different music strings. However, there is no possibility to change the sound character of a music string in fine nuances.

It is therefore an object of the invention to provide a method of the above-mentioned kind that avoids the mentioned disadvantages and that allows the musician to change and/or adapt the sound character of a music string.

In accordance with the invention, in a method for stringing a stringed musical instrument, e.g., a violin, a first end of a music string is introduced into a stretching device of the stringed musical instrument, wherein a second end is secured, preferably attached, to a holding device of the stringed musical instrument, in particular a string holder, and the music string is tightened by means of the stretching device, wherein the music string is twisted, before tightening, about its longitudinal axis, in particular to a degree that can be predefined.

As a result, the musician may change the sound character of the music string in fine nuances and match the sound character to the respective instrument and/or composition.

The sub-claims, which, like the patent claims 1 and 13, form part of this disclosure, relate to further advantageous embodiments of the invention.

BRIEF DESCRIPTION OF THE DRAWING

The invention is described in more detail with reference to the drawings, which illustrate merely examples of preferred embodiments. The drawings show in:

FIG. 1 shows a music string 1, in particular for bowed instruments and/or plucked instruments, having at least a first play area 2, with the first play area being provided for a musician to induce tone-generating vibrations. Under identical test conditions that can be predefined, the first play area 2 has at least a first area 3 exhibiting a first vibration behavior and a second area 4 exhibiting a second vibration behavior that is different from the first vibration behavior.

In this way, music strings 1 can be formed that exhibit a particularly balanced and open sound character over the entire frequency range usable for playing and that have particularly balanced handling characteristics. Due to the different vibrations characteristics in the different playable areas and/or the different frequency ranges under identical test conditions, the differences of the different effective string lengths and/or the unique characteristics of musical instruments can be taken into account and compensated for. As a result, undesired unique characteristics and/or defects of the string instruments such as wolf tones, whir tones, and/or problems in the tone inducement can be effectively prevented by, for example, changing the impedance of the music string 1 in some areas, and suited to the input impedance of the musical instrument. This leads to further possibilities for individual sound adjustment by the musician because such music strings very strongly respond to the twisting of the music string 1 by the musician. Thus, such music strings may change their sound character. It is therefore possible for the musician to fine tune the music string 1, whereby the music string can be matched even better to the instrument and/or the musical composition to be performed.

Such music strings 1 may be preferably used for instruments of the violin family, i.e., a violin or fiddle 9, a viola, a cello, and a bass and/or a bass fiddle. Further preferred instruments to be used with the strings according to the invention are guitars and mandolins. Fundamentally, such strings according to the invention may be provided for all bowed and plucked string instruments, such as, cembalos, harps, banjos, sitars, dulcimers, citterns, lutes, Ud, P'l-P'a, gekkin, balalaika, Vina, Tampura, Koto, Soh, etc.

Figure 1:
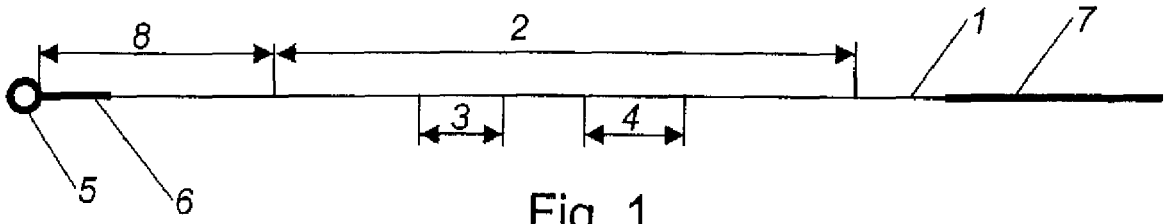
FIG. 1 a music string in accordance with the invention.

Generally, the music strings 1 have a means for attaching the music string 1 to a part of the respective musical instrument. In simple embodiments, these means for attaching the music string can be a loop or a knot of the music string 1. Preferably, as shown in FIG. 1, a first end of the music string 1 terminates in a sleeve or a ball which is also generally referenced as knob 5, made in particular of metal. Further, the music string 1 preferably has on at least one end a so-called thread covering 6, 7. As shown in FIG. 1, it is particularly preferable that the music string 1 has a first thread covering 6 at its first end and a second thread covering 7 at its second end to protect the music string 7 from excessive edge load when it is clamped at the tuning pegs of the musical instrument 1. The thread coverings 6, 7, which are often colored and made of plastic and/or natural fibers and/or an elastic coating, assist with the labeling of the different music strings 1. The elastic coating is applied by, e.g., immersing the first and/or second end of the music string 1 in an immersion bath.

Figure 2:
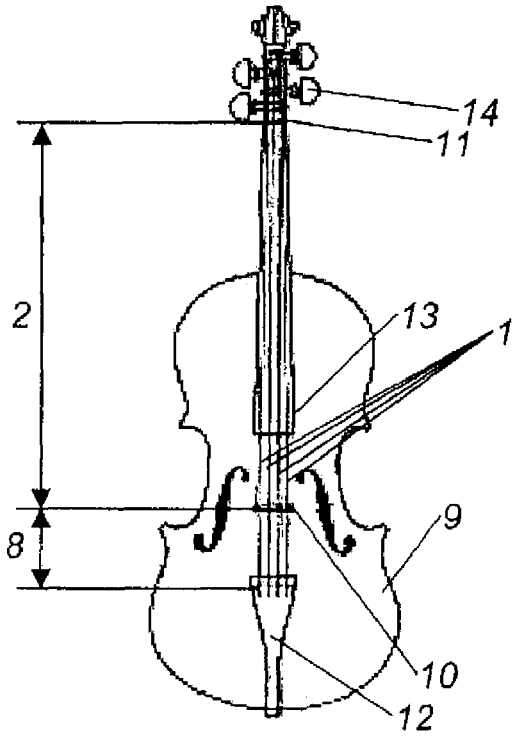
FIG. 2 a violin having a music string in accordance with FIG. 1.

The music strings 1 according to the invention have a first play area 2. The first play area 2 is provided for the musician to induce tone-generating vibrations. Thus, the first play area 2 is the area in which the musician induces vibrations of the music string 1, e.g., by bowing with a bow and/or by plucking with the fingers and/or by striking with a hammer. Furthermore, the first play area 2 is the area in which the musician shortens the music string 1 so as to form different tones and, thus, vibrations of different frequency. Typically, this happens due to the musician pressing the music string 1 with his fingers or with a mechanical clamp against a support of the music instrument, such as the fingerboard 13 of a violin 9. Typically, string instruments have mechanical borders that clearly delimit the first play area 2. In the case of the violin 9 and/or the instruments of the violin family, the first play area 2 is clearly confined on the instrument by the bridge 10 at a first side and by the tailpiece 11 at a second side, as shown in FIG. 2. The distance between the bridge 10 and the tailpiece 11 is known as diapason and is, for a given group of instruments, predefined within small tolerances. For example, in the case of a modern 4/4 violin 9, the diapason is about 32.5 cm, wherein the deviation among the individual instruments is typically less than +/−1 cm. Thus, the first play area 2 is as long as the diapason. In the case of musical instruments where different individual instruments have very different diapasons, e.g. violas, for which it is not unusual to have diapasons in the range from about 35 cm to 44 cm, it is preferable to offer multiple sets of music strings. Each of the sets is provided for a narrow diapason range, such as for violas having a diapason in the range from 36 cm to 39 cm. To compensate for such inaccuracies, an overlap area may be provided between the first area 3 and the second area 4. This overlap area whose extension is preferably longer than 0.5 mm, and preferably in the range from 1 mm to 15 mm, allows for a smooth and soft transition between the first and second area 3, 4 and assists in compensating for position tolerances of the music string 1 on the musical instrument. Therefore, in the case of a music string having a distinct overlap area, the musician does not feel a clear sharp border in the border area between the first and second areas 3, 4, so that the overall harmonic perception of the music string 1 can be further improved.

The music strings 1 are produced in different key tones. This key tone is the tone and/or the frequency with which the first play area 2 vibrates at a predefined tension of the music string 1 if the first play area 2 has not been further shortened by the musician. The tension, which can be predefined, is typically referenced as a mass and/or so-called tuning weight that must be attached at a music string 1 clamped on one side so that the first play area 2 vibrates at the given key tone of the music string 1.

During playing, the musician presses the music string 1 against the fingerboard 13 of the instrument so as to generate different tones. Thereby, the effective length of the music string 1 is shortened and the tension in the music string 1 is simultaneously increased. Since the distance between the music string 1 and the fingerboard 13 is not constant but, instead, steadily increases as the string lengths steadily decrease and, thus, the tones and/or musical harmonies become steadily higher, the tension in the music string 1 too steadily increases as the effective string length steadily decreases. Together with the fact that the vibration ability of the music string 1 is already hampered due to the short string length, this has the effect that conventional music strings typically exhibit a different sound character at short vibrating string lengths and/or at higher tones and/or at higher musical harmonies than at low harmonies for which a long string length is available. Therefore, conventional music strings 1 often sound narrow at higher harmonies.

Typically, music strings 1 are hooked to the musical instrument via the knot 5, whereas the other end of the music string 1 is led through a stretching device, known as the tuning pegs 14 in the case of the violin, by means of which the music string 1 is tightened to the necessary, predefined level so that the music string 1 has the intended key tone. In the case of the violin 9 and/or the instruments of the violin family, the music strings 1 are hooked to a string holder 12 via the knob 5 and extend from there to the bridge 10. Generally, the first partial area 8 between the string holder 12 and the bridge 10 has only small longitudinal tolerances so that, even in the case of a music string 1 that is not clamped on a musical instrument, the first play area 2 is substantially well identifiable.

The first play area 2 of the music strings 1 according to the invention has, under identical test conditions that can be predefined, at least a first area 3 having a first vibration behavior and a second area 4 having a second vibration behavior, wherein the first vibration behavior is different from the second vibration behavior.

According to the invention, the first play area 2 can have further areas with, under identical test conditions that can be predefined, different vibration behaviors with regard to their respective first and/or second areas 3, 4. The present invention is described below with reference to only the first and second areas 3, 4. However, this is not to limit in any way the scope of the present invention to only a first and second area 3, 4. Instead, any number of respective areas 3, 4 may be provided.

DETAILED DESCRIPTION OF PREFERRED EMBODIMENTS

The first and second area 3, 4 can be arranged at any predefined location of the first play area 2. Therein, the first and second areas 3 and 4 may border each other or a further area may be arranged between them. The first and/or second area 3, 4 may have any predefined longitudinal extension, wherein, in particular, the first and/or the second area 3, 4 have a length of at least 0.5 cm. Preferably, the first and/or the second area 3, 4 have a length between 3 cm and 15 cm. It is particularly preferable that the first area 3 is arranged in a playable and/or musical position that can be predefined and that the second area 4 is arranged in another position that is different from the first position and/or that the length of the first or second area 3, 4 equals the length of a position. The position designated hereby the position of the hand at the fingerboard of the instrument.

In accordance with the invention, the first and second areas 3, 4 exhibit a respectively different vibration behavior under identical test conditions, which can be predefined. Preferably, the term "vibration behavior" means any vibrational or acoustic behavior, e.g., different fade-in behavior, fade-out behavior, tone color spectrum and/or partial tone distribution, etc. Preferably, a different vibration behavior already exists when the vibration behavior of the first area 3 is different in any point from the vibration behavior of the second area 4. However, the above-mentioned different vibration behavior may also relate to predefined partial areas of the acoustic characteristics and/or the vibration behavior of the music string 1. Further, the vibration characteristics of the music string 1 may continuously change along its length in the first play area 2, so that the bending stiffness preferably decreases steadily from the tailpiece 11 to the bridge 10. Even a music string 1 of this kind has a first and second area 3, 4 in accordance with the invention since two areas of small spatial dimension that do not immediately border each other show already different vibration behaviors.

The term "same test conditions" means that the first area 3 taken alone is tested under first test conditions, and that the second area 4 taken alone is tested under identical first test conditions. Test conditions may differ in, e.g., the tuning weight and, thus, the tension of the music string; the ambient temperature; the humidity; the method of vibration inducement, e.g., bowing or plucking; the measured variable; and much more. Preferably, the area to be measured, i.e., the first or second area 3, 4, may be clamped on a monochord having a bridge that includes a piezo-electric detector, and the music string 1 and/or the first or second area 3, 4 may be plucked so as to induce vibrations. In addition, preferably the fade-out behavior and the partial tone distribution is measured such that the vibration behavior of the first and/or the second area is measured. However, other test conditions may be provided.

To accomplish the different vibration behavior in the first and second area 3, 4, it is preferable that the second area 3 is different from the first area 4 in at least one mechanical characteristic. The music strings 1 have a multitude of different mechanical characteristics that can be influenced and/or predefined during production. It has proven to be particularly advantageous for the production of the music strings 1 as well as their play characteristics and acoustic characteristics that, under identical test conditions that can be predefined, the first area 3 has a first torsional stiffness and that the second area 4 has a second torsional stiffness that is different from the first torsional stiffness; and/or that the first area 3 has a first bending stiffness and the second area 4 has a second bending stiffness that is different from the first bending stiffness; and or that the first area 3 has a first mass covering and the second area 4 has a second mass covering that is different from the first mass covering; and/or that the first area 3 has a first diameter and the second area 4 has a second diameter that is different from the first diameter, wherein any possible combinations of two or more of the aforementioned influence possibilities may also be provided. As a result, music strings 1 may be produced in a simple and reproducible manner having different play characteristics and acoustic characteristics in different first and second areas 3, 4, whereby the aforementioned advantages of such music strings 1 can be achieved in simple and reproducible manner. Therefore, in a particularly preferred embodiment of the music strings 1 in accordance with the invention, the bending stiffness and/or the torsional stiffness decreases as the musical harmonies become higher and, thus, the string length becomes shorter. Thus, the music string 1 has a first area 3 preferably in the area of the fingerboard 13 near the bridge 10 and a second area 4 near the tailpiece 11, and the first area 3 has, under identical test conditions that can be predefined, a torsional stiffness and/or a bending stiffness that is less than the torsional and/or bending stiffness in the second area 4. Therefore, the music string 1 vibrates better as the harmonies become higher.

Special measurement apparatuses exist to measure the torsional stiffness and/or the bending stiffness, whereby it is particularly important for a first method of measuring the torsional stiffness and/or the bending stiffness that the respective music string 1 and/or the first and/or second areas 3, 4 to be measured are subjected to load stress, in particular by means of the tuning weight, since both the torsional stiffness and the bending stiffness depend on the tension of the music string 1. As an alternative, in a second method of measuring the torsional stiffness and/or the bending stiffness, the music string 1 can be preferably horizontally clamped and/or held in an unloaded state at a predefined first location, and the music string must have a bending line that can be predefined. Depending on the bending and/or torsional stiffness, the music string is stiffer or more bendable and therefore has different bending lines from area to area. Thus, the music string has areas that run in a very straight line and areas that are very curved. Such as second method for measuring the torsional stiffness and/or the bending stiffness is particularly advantageous with respect to quality control in producing music strings according to the invention. Measuring the mass covering, and, thus, the mass per distance unit, as well as the diameter is not a problem for one skilled in the art.

Music strings 1 according to the invention may be provided in different embodiments, for example as a metal string and, thus, as a single metal wire that is preferably made of titanium and/or titanium alloys and/or steel and/or made of alloy ingredients selected from the group including: carbon, chromium, nickel, molybdenum, vanadium, manganese, and tungsten, whereby particularly preferred types of steel are carbon steel (C-content in the range from 0.01% to 0.03% by weight) and chromium-nickel steel (Cr-content in the range from 17% to 20% by weight, Ni-content in the range from 8% to 10% by weight), whereby metal strings can be provided that are blank or that are coated with an additional metal. Music strings 1 in accordance with the invention embodied as metal strings, are plastically wound between the first area 3 and the second area 4. Therefore, the music string 1 may be overwound and/or twisted in some areas during production. This "twisting" is maintained even when the music string 1 is complete and changes its vibration behavior in this area. Such music strings 1 preferably have a plastic twist in at least the first area 3. As a result of this configuration, even blank and/or coated music strings 1 can be embodied as the music string 1 according to the invention, and preferably as the a-string and, first and foremost, the e-string of the violin. In a manner that is equivalent to the above-described embodiment of music strings according to the invention as a metal string, the music strings may be embodied as a blank and/or coated gut string, with a polymer and/or metal coating being provided. Furthermore, the gut string has a plastic twist.

Preferably, the music strings 1 according to the invention have a core that is wrapped by at least one winding, in particular in helicoid manner, wherein the core preferably includes natural gut, plastic and/or metal. This results in a multitude of possibilities to change the torsional stiffness and/or the bending stiffness and/or the mass covering and/or the diameter from area to area.

The core of a music string 1 according to the invention can include any material selected from the group of metals, in particular steel and/or titanium, synthetic fibers such as carbon fibers, glass fibers, polymer fibers, in particular polyamide, aramide fibers, PEK, PEEK, PBT, polyester, nylon, polyethylene, PET, PEET, PES, PE, PP, POM, PTFE, PVDF, PVD and/or PVC. The material can also include any plant-based and/or animal-based fiber, such as silk and/or natural gut. It is particularly preferable that the core includes steel, and in particular carbon steel (C-content from 0.01% to 0.03% by weight) and chromium-nickel steel (Cr content from 17% to 20% by weight, Ni-content from 8% to 10% by weight), aramide fibers and/or nylon fibers.

The core may be embodied as a single wire and/or a single fiber. Preferably, the core can have a predefined plurality of individual elements that can be intertwined and/or stranded, wherein any number of intertwined and/or stranded individual elements may be provided. Thereby, the individual elements may have a predefined shape and a predefined cross section. In particular, the cross-section of at least one individual element may be round or may be the segment of a circle or a polygon, such as a triangle, a hexagon and/or a trapezoid.

Preferably, the individual elements may have a first twist in the first area 3 and, under identical test conditions that can be predefined, a second twist in the second area 4 which is different than the first twist. The second twist which is different than the first twist can be different both in terms of the degree of twist and in terms of the turning direction. By changing the degree of the turning direction, the torsional stiffness and/or the diameter of the music string may be influenced. By reversing the turning direction of the twist, the torsional stiffness may be influenced in a particularly strong way. Therefore, it is, for example, possible, that the first area has a core which is comprised of a predefined number of individual elements and twisted in a left-hand direction, and the second area of the same core is twisted in a right-hand direction however.

Further possibilities to change mechanical properties of the music string 1, in particular the diameter and the mass covering involve changes to the wrapping. By changing the distance between adjacent helicoidally attached wrappings or windings, the bending stiffness as well as the mass covering may be changed in a predefined manner.

The invention further relates to a method for stringing a stringed music instrument, such as a violin 9, with a music string 1, preferably a music string according to the invention, with the music string 1 having one end being introduced into a stretching device of the stringed music instrument, a second end secured, preferably hooked, to a holding device of the stringed music instrument, in particular a string holder 12, and tightened by means of the stretching device. In order to enable the musician to change or match the sound character of a music string, it is proposed to wind-in the music string 1 before stretching about its longitudinal axis, especially to a predefined degree, so that the sound character of the music string can be changed by the musician in fine nuances and the respective instrument or musical piece can be adjusted. Any type of clamping and turning-in may be provided, for example by attaching the music string 1 with the knob 5 to the string holder 12, by having the musician or person which strings the instrument, to twist the string about its longitudinal axis in a predefined manner, for example by three turns. It is especially preferred that the music string 1 is twisted about its longitudinal axis, especially in a predefined manner, before attachment to the holding device, e.g. the string holder, while the first end is substantially constraint against rotation in the stretching device, e.g. the tuning pegs of a violin, so that as to establish an especially simple, reproducible and uncomplicated procedure.

Further embodiment of the invention may involve any combination of one or more features set forth in the patent claims. In particular embodiments may be provided, which have only some of the described features, wherein any combination of features, especially also of various embodiments, may be provided.

What is claimed is:

1. A music string, comprising at least a first play area for a musician to induce tone-generating vibrations, the play area including at least a first area having a first vibration behavior and a second area having a second vibration behavior, wherein the first vibration behavior is different from the second vibration behavior, when undergoing identical and predefined test conditions, and wherein the first area has a first torsional stiffness, and the second area a second torsional stiffness that is different from the first torsional stiffness.

2. The music string of claim 1, for application on at least one of a bowing instrument and a plucking instrument.

3. The music string of claim 1, wherein the second area is different from the first area in at least one mechanical characteristic.

4. The music string of claim 1, wherein the first area is arranged in a predefined first position, and the second area is arranged in a second position that is different from the first position.

5. The music string of claim 1, further comprising a core and at least one winding wrapped around the core.

6. The music string of claim 5, wherein the at least one winding is wrapped around the core in a helicoid manner.

7. The music string of claim 5, wherein the core is made of at least one material selected from the group consisting of natural gut, plastic, and metal.

8. The music string of claim 5, wherein the core is a rope.

9. A music string, comprising at least a first play area for a musician to induce tone-generating vibrations, the play area including at least a first area having a first vibration behavior and a second area having a second vibration behavior, wherein the first vibration behavior is different from the second vibration behavior, when undergoing identical and predefined test conditions, and wherein the first area has a first bending stiffness, and the second area has a second bending stiffness that is different from the first bending stiffness.

10. A music string, corn prising at least a first play area for a musician to induce tone-generating vibrations, the play area including at least a first area having a first vibration behavior and a second area having a second vibration behavior, wherein the first vibration behavior is different from the second vibration behavior, when undergoing identical and predefined test conditions, and wherein the first area has a first mass covering, and the second area has a second mass covering that is different from the first mass covering.

11. A music string, comprising at least a first play area for a musician to induce tone-generating vibrations, the play area including at least a first area having a first vibration behavior and a second area having a second vibration behavior, wherein the first vibration behavior is different from the second vibration behavior, when undergoing identical and predefined test conditions, and wherein the first area has a first diameter, and the second area has a second diameter that is different from the first diameter.

12. A music string, comprising at least a first play area for a musician to induce tone-generating vibrations, the play area including at least a first area having a first vibration behavior and a second area having a second vibration behavior, wherein the first vibration behavior is different from the second vibration behavior, when undergoing identical and predefined test conditions, the music string further comprising a core and at least one winding wrapped around the core, wherein the core includes a plurality of intertwined individual elements, the individual elements having a first twist in the first area, and a second twist in the second area, wherein the first twist is different from the second twist.

13. A music string, comprising at least a first play area for a musician to induce tone-generating vibrations, the play area including at least a first area having a first vibration behavior and a second area having a second vibration behavior, wherein the first vibration behavior is different from the second vibration behavior, when undergoing identical and predefined test conditions, the music string further comprising a core and at least one winding wrapped around the core, wherein the core is made of a single metal wire, said music string being plastically intertwined between the first area and the second area.

14. A music string, comprising at least a first play area for a musician to induce tone-generating vibrations, the play area including at least a first area having a first vibration behavior and a second area having a second vibration behavior, wherein the first vibration behavior is different from the second vibration behavior, when undergoing identical and predefined test conditions, wherein the music string is made of a single metal wire which is free of a wrap-around winding and plastically intertwined between the first area and the second area.

15. The music string of claim 14, wherein at least the first area has a plastic twist.

* * * * *